US005560083A

United States Patent [19]

Teixeira

[11] Patent Number: 5,560,083

[45] Date of Patent: Oct. 1, 1996

[54] CARRY HANDLE FOR A LUGGAGE CASE

[75] Inventor: George A. Teixeira, Warren, R.I.

[73] Assignee: Samsonite Corporation, Denver, Colo.

[21] Appl. No.: 397,523

[22] Filed: Mar. 2, 1995

[51] Int. Cl.[6] ..... E05B 7/00; A45C 13/00

[52] U.S. Cl. ..... 16/119; 16/125; 16/116 R; 16/111 R; 190/115; 190/39

[58] Field of Search ..... 16/119, 125, 116 R, 16/124, 116 A; 190/115, 39

[56] References Cited

U.S. PATENT DOCUMENTS

| | | | |
|---|---|---|---|
| 944,366 | 5/1909 | Knapp | 16/125 |
| 1,171,528 | 10/1915 | Lowy | 190/115 |
| 1,268,500 | 6/1918 | Schlegel | 16/125 |
| 1,350,650 | 8/1920 | Handler | 16/111 R |
| 1,357,554 | 11/1920 | Goldbaum | 16/111 R |
| 1,554,228 | 9/1925 | Olshan | 16/125 |
| 4,696,077 | 9/1987 | Kim | 16/125 |

*Primary Examiner*—M. Rachuba
*Assistant Examiner*—Adesh Bhargava
*Attorney, Agent, or Firm*—Gregory W. O'Connor; Rod D. Baker

[57] ABSTRACT

Handles to carry luggage handles have been made of a variety of materials and in a variety of styles. Some require specially molded, cast, or stamped parts of plastic, rubber or metal. But, such handles tend to be expensive and heavy. Here a handle is constructed from a pair of webbing pieces edge stitched to form an elongated tube into which a specially constructed filler member or core is inserted. This core comprises a central stiffening member of a tempered steel wire rod and a plastic tube. Several layers of foam padding are wound around this member, and the entire assembly is slid into the cavity formed by the edge sewn webbing pieces to form a grip. The lengths of the webbing pieces are such to form integral straps for attaching the grip directly to a luggage case.

8 Claims, 2 Drawing Sheets

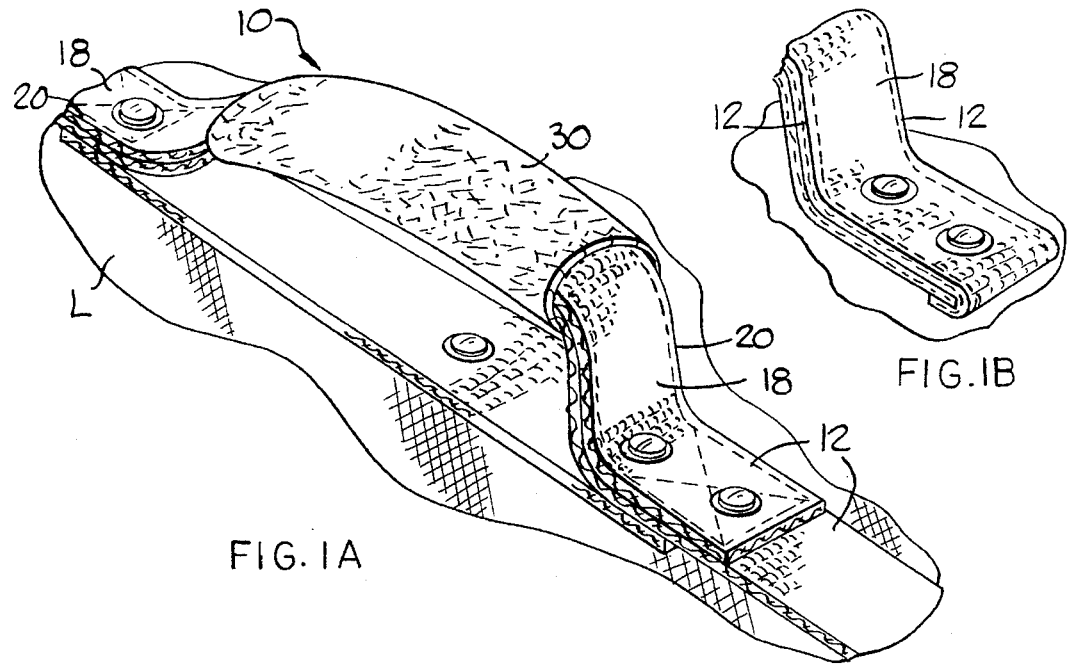
FIG. 1A
FIG. 1B
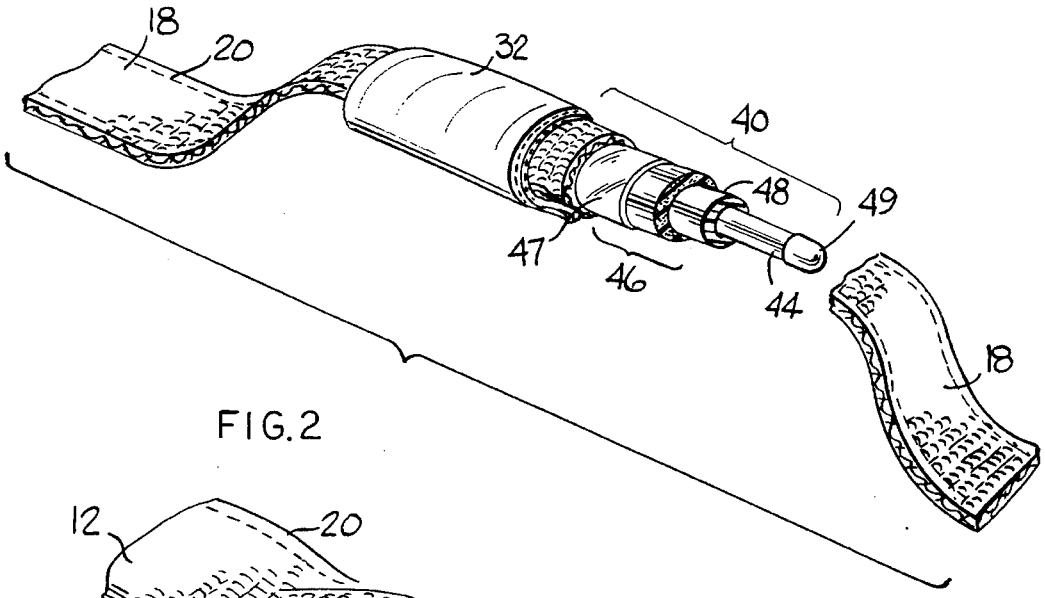
FIG. 2
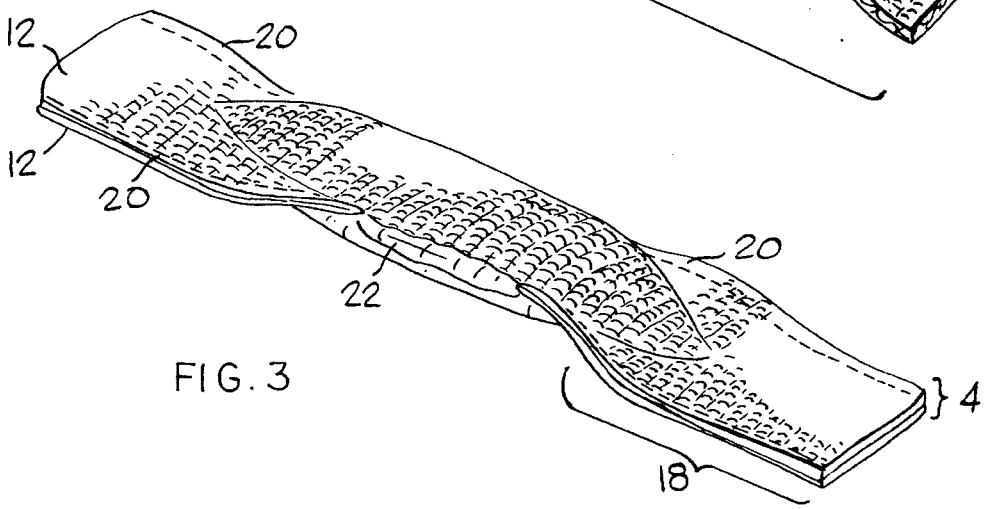
FIG. 3

CARRY HANDLE FOR A LUGGAGE CASE

BACKGROUND OF THE INVENTION

Luggage cases typically are provided with at least some type of handle by which the luggage case can be carried by its user. A range of handles are available from the simple bail handle comprising a loop of webbing stitched to the top of the case to complex constructions comprising injection molded grips and plated metal portions, etc. The best of these handles share some characteristics. For example, a desirable handle is padded to reduce pressure points on the palm or the finger pads of the user. Such undue localized pressure can lead to fatigue and pain. Indeed, an unduly stiff handle can result in the sense that the luggage case being carried is heavier than it actually is because of the localized pressure and pain. A well-designed handle provides support across the full width of the user's hand. A simple bail handle which forms a catenary curve when supporting the weight of a luggage case characterizes a compromised handle construction since it is unlikely to provide uniform support across the width of the user's hand. Molded handles, that is those including injection molded handle padded portions with steel spines as shown in U.S. Pat. No. 4,280,247, characterize a better form of handle. However, these engineered handles are expensive and relatively heavy. Accordingly, it is an object of the invention to provide a simple, inexpensive, and versatile handle construction which provides a comfortable padded grip portion as well as a grip portion which is structurally sound and provides a broad support across the width of the user's hand.

It is another object of this invention to provide a method of constructing a luggage carry handle that uses simple materials readily available from the construction of the luggage case itself, not requiring complex and expensive injection molded parts or operations, yet provides a comfortable and aesthetically pleasing grip and integral attachment portions.

BRIEF DESCRIPTION OF THE INVENTION

Accordingly, provided here is a handle for a luggage case comprising two lengths of a woven webbing. The longitudinal edges of these lengths of woven webbing are attached together as by sewing to form a tubular cavity enclosed by a central portion of these two lengths of webbing. A cylindrical member is wedged in this tubular cavity. This cylindrical member comprises a central rigidifying member and an annular cushion member surrounding the rigidifying member. An outer covering is provided which engages the outside of the woven webbing and surrounds this tubular cavity. This outer covering forms a gripping surface for the handle. Also provided is a method for making the handle for the luggage case comprising the steps of forming a generally cylindrical core comprising a rigidifying member surrounded by a cushion member. This cylindrical core has an axial length about the length of the grip portion of a luggage case handle. Then provided is a step of cutting from a supply of woven webbing to form a pair of lengths of woven webbing. The longitudinal dimension of each of the pair of lengths being at least long enough to form a grip portion at a central location along the lengths of webbing and straps for connecting the handle to a luggage case to either side of that central location. Then the pair of lengths of webbing are positioned face-to-face to place the longitudinal edges face-to-face with one another. The positioned pair of lengths of woven webbing are attached together face-to-face by forming a seam at the adjacent longitudinal edges thus forming an elongated collapsed tube with openings into the tube at opposite ends near the ends of the pair of lengths of woven webbing. After completing this step, further is provided the step of inserting the cylindrical core between the thus sown pair of lengths of webbing by pushing the core through an opening into the collapsed tube and sliding the core to a central location of the pair of lengths of woven webbing.

BRIEF DESCRIPTION OF THE FIGURES

FIGS. 1A and 1B show a luggage case and carrying handle according to the instant invention.

FIG. 2 shows a partial sectional view illustrating the various parts of the luggage handle FIG. 3 is a perspective view of the grip portion of the inventive handle during processing.

DETAILED DESCRIPTION OF THE PREFERRED EMBODIMENT

Figure 4:
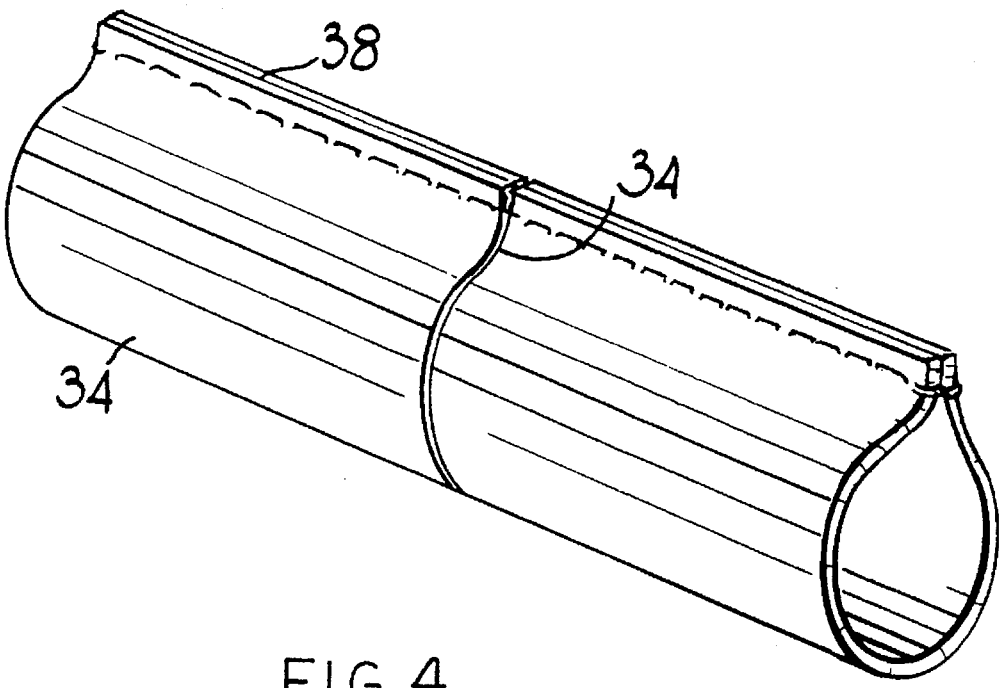
FIG. 4 is a perspective view of the outer covering of the grip portion during processing.
Figure 5:
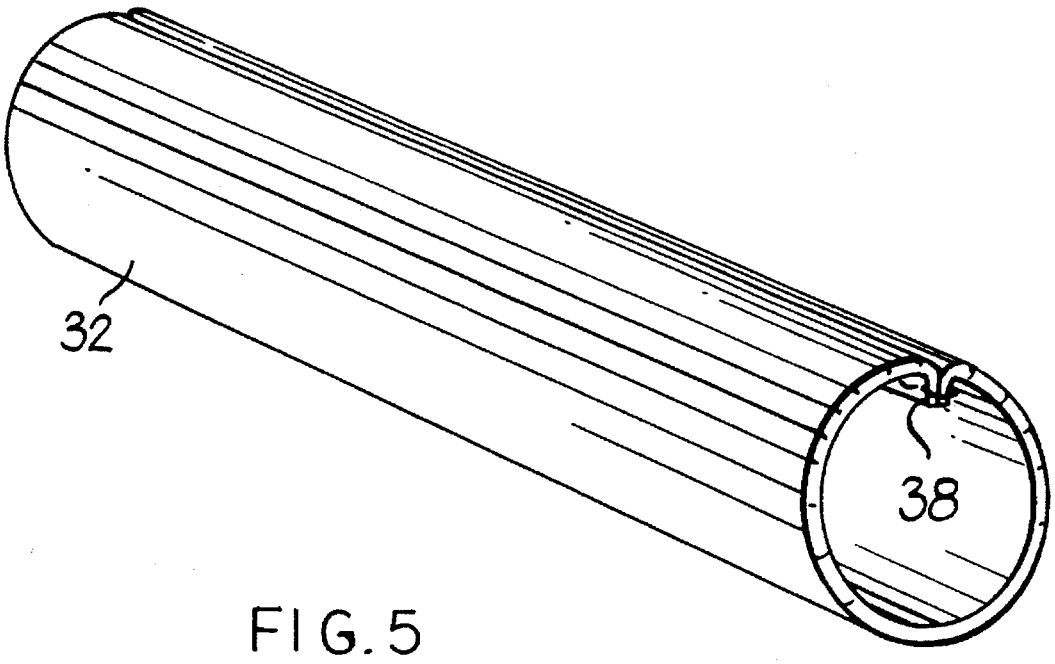
FIG. 5 is a perspective view after processing of the outer covering of the grip portion shown in FIG. 4.

Referring to the figures, the handle 10 comprises a grip portion 30 and a pair of flexible straps 18 and 18 extending from each end. These straps are preferably attached directly to a side of a luggage case L of conventional construction. Such attachment can be accomplished many ways, but shown is a conventional rivet and bar tack stitching method. The grip has a cylindrical member extending along its length and terminating about where the straps extend beyond and bend down towards the luggage case L. As can be seen more clearly in FIG. 3, there are two lengths of woven webbing 12 which are sewn face-to-face and extend the full length of the inventive handle. This webbing is preferably of thermoplastic fibers, such as polypropylene or nylon. Such webbing is conventionally used in luggage construction for its toughness, abrasion resistance, and color fastness. Here, it has the extra advantage of being fusible or meltable with the application of a heated iron. The two ends of these lengths of face-to-face webbing pieces constitute the straps 18 and 18, while the central portion between these straps constitutes part of the grip portion. The longitudinal edge portions 14 of the webbing lengths 18 are sewn or stitched together to form seams 20. However, these seams in the central portion corresponding to the grip are melted or fused together to form melted seam 22 which has the advantage of being generally more flat and flush to the desired circular cross-section of the grip.

This edge stitching and the desired melted seam along the length portions of the webbing pieces 12 form an elongated, generally cylindrical cavity which tends to be collapsed until a cylindrical member 40 is inserted to a position between the strap portions 18. Once inserted, the cylindrical member is completely hidden within the cavity between the webbing lengths. Normally, a grip outer covering 32 is provided to envelop the central portion and the cylindrical member 40 within. The cylindrical member 40 is itself made of a rigidifying member which is surrounded by an annular cushion member 46. Since the handle should resist bending when being held to support a heavy luggage case, the member comprises a length of very stiff, resilient steel wire 44, preferably the type of tempered steel wire used in the luggage industry in edge binding or beading to provide a stiffening edge around luggage panels and the like. This wire is inserted into a slightly shorter length of small diameter plastic tubing 48. This tubing serves as a core about which layers of foam plastic may be spirally wrapped to form the cushioning member 46. In order to resist the tendency of wire 44 to slide out of the plastic tubing 48, small rubbery end caps 49 are stretched over the wire ends and inserted part of the way into the end of the plastic tube.

Enough wraps, usually about three, of the foam plastic are made around the tube 48 to fit snugly into the cavity inside the stitched and edge fused webbing. But by its very nature, the foam plastic resists sliding into this snug cavity. So, the thus wrapped foam surface is in turn covered with conventional plastic film type adhesive tape 47. This tape presents a smooth, durable exterior surface which easily slides along the interior surfaces of the lengths of webbing 12. Usually, a small diameter wood dowel is used to urge the thus wrapped member 40 into the webbing and center the member between the flanking straps 18.

The outer covering 32 of the grip is usually made as a subassembly, then slipped over the thus filled webbing. The covering starts as a rectangle of ordinary vinyl imitation leather. A strip of double sided tape is laid down the center on the back side of this rectangle, and the opposite edges parallel to this strip of tape are folded in to abut one another and be held in place by the double sided tape. This forms the central seam 34 shown in FIG. 4. Then, the other two cut edges are brought together and stitched along these edges to form a cylindrical preform with the standing seam 38 as shown. This assembly is heated in a radiant heat oven a few minutes to make the vinyl leather layers 34 soft and rubbery. This oven is easily assembled from a simple metal box large enough to manually insert and remove the grip preforms. The preforms are heated by an ordinary 250 watt infrared reflector type incandescent bulb positioned to shine into the box through a circular hole in the top face of the box. The heating cycle takes only one or two minutes. In this heated condition, the preform 36 can be easily turned inside out and allowed to cool. This operation forms a cylindrical grip cover 32 with circular end edges that do not require finishing, and with a clean, almost invisible sewn seam on one side. This completed cover 32 is forced over the otherwise completed carry handle until it is centered over the member filled center section.

Finally, the completed handle 10 is trimmed and installed on a luggage case in a conventional manner. In FIG. 1A, the upper length of webbing 12 extends a substantial distance beyond the lower length 12. A separate piece of webbing is shown sewn to the luggage case surface immediately below the grip portion and straps, terminating below the rivets that attach the straps 18 to the case. In this way, the webbing straps integrate smoothly with the look of the rest of the case. FIG. 1B shows an alternate way to terminate the webbing pieces 12. Here, the upper end of the upper webbing 12 is wrapped around and under the lower webbing, and then both are sewn and riveted to the luggage case L. Thus, the end of the strap 18 is provided with a finished end.

In a particular handle construction according to the instant invention, off the shelf webbing from the Elizabeth Webbing Company was used to make the pair of webbing lengths about 1.5 inches wide and at least 12 inches long. These were stitched and fused as set forth above. A cylindrical member was made using plastic foam sheeting about 0.125 inches thick. This material is available from many supply houses. The vinyl leather was a conventional type having a nominal thickness of about 0.010 inches to about 0.012 inches in the form of a rectangle about 9.0 inches long and about 3.75 inches wide. The stiffening wire was about 0.012 inches in diameter and about 4.0 inches long. The extruded plastic tube 48 containing the wire 44 and end caps 49 was about 0.25 inches in diameter.

This construction made a handle that was extremely elegant, having no seams in the grip portion, yet the handle includes edge stitched webbing protruding from either side of the grip that curved gracefully down to the riveted portions on the top of the luggage case. The handle was extremely easy to make, requiring only materials normally found in the luggage factory and, except for the relatively simple radiant heater, required no special tooling.

While a particular construction is shown, variations within the scope of the appended claims are contemplated or can be easily imagined with the benefit of this disclosure. For example, because the lengths of all the materials can be easily varied, handle grips of varying lengths, firmness or even diameters (with wider webbing) can be easily made.

I claim:

1. A handle for a luggage case comprising two lengths of woven webbing, the longitudinal edges thereof being attached together as by sewing to form a tubular cavity enclosed by a central portion of the two lengths of webbing, a cylindrical member wedged in the tubular cavity, said cylindrical member having two axial ends and comprising a central rigidifying member and an annular cushion member in contact with and surrounding the rigidifying member, said tubular cavity being longer than said cylindrical member, and an outer covering engaging the outside of the woven webbing and surrounding the tubular cavity, the outer covering forming a gripping surface for the handle, wherein the two lengths of woven webbing extend longitudinally substantially beyond both axial ends of the tubular cavity and are secured to the luggage case to define a pair of flexible straps extending between the respective axial ends of the cylindrical member and the luggage case, whereby the cylindrical member is connected to the luggage case.

2. A handle for a luggage case as set forth in claim 1 wherein the lengths of webbing have facing longitudinal edges which extend along the pair of flexible straps and along the tubular cavity, these facing longitudinal edges are stitched together to form an outwardly extending seam.

3. A handle for a luggage case as set forth in claim 1 wherein the woven webbing is made from a heat fusible material, and the facing longitudinal edges are fused along most of the length of the tubular cavity whereby the outwardly extending seam is melted substantially flush with the outer surface of the tubular cavity.

4. A handle for a luggage case as set forth in claim 1 wherein the outer covering comprises at least one layer of simulated leather.

5. A handle for a luggage case as set forth in claim 4 wherein the outer covering comprises two layers of simulated leather, each layer of simulated leather having a front side and a back side, the two layers being back side to back side, rolled and sewn with stitches to define a generally cylindrical tubular shape having a seam along its axial length, said stitches being fully contained within the interior of said tubular shape.

6. A handle for a luggage case as set forth in claim 1 wherein the rigidifying member comprises a resilient steel wire in the center, end caps on each axial end of the wire, and an extruded plastic tube over the wire and at least a portion of each of the end caps.

7. A handle for a luggage case as set forth in claim 1 wherein the annular cushion member comprises a rectangle of foam polymer wrapped spirally around the rigidifying member with an outer annular layer of plastic film typed adhesive tape, the layer of tape functioning to reduce friction between the cylindrical member and the webbing material whereby the cylindrical member may be pushed into the tubular cavity to position the cylindrical member between the flexible straps.

8. A method of making a handle for a luggage case comprising forming a generally cylindrical core comprising a rigidifying member surrounded by a cushioning layer, the cylindrical core having an axial length about the length of a grip portion of a luggage case handle, cutting from a supply of woven webbing a pair of lengths, the longitudinal dimension of each of the pair of lengths being at least long enough to form a grip portion at a central location and a means of connecting the handle to a luggage case, positioning the pair of lengths face to face to place the longitudinal edges face to face, attaching the pair of lengths of woven webbing together face to face by forming a seam at the adjacent longitudinal edges, thus forming an elongated but collapsed tube with openings into the tube at the opposite ends of the pair of lengths of woven webbing, inserting the cylindrical core between the thus sewn pair of lengths of woven webbing by pushing the core through an opening into the collapsed tube, sliding the core to the central location of the pair of lengths of woven webbing; and supplying an outer covering for the grip portion by providing a single rectangular sheet of cover material, laying a strip of adhesive tape down the center of a first side of the sheet, folding the opposite edges of the sheet that are parallel to the tape in to abut one another and be held by the tape, bringing together the other cut edges and stitching them together to form a generally tubular preform, heating the preform, turning the preform inside out so that said first side of the sheet is interior to the preform, and slipping the preform over the pair of lengths of woven webbing.

* * * * *